United States Patent [19]

Pritchett

[11] Patent Number: 4,641,595

[45] Date of Patent: Feb. 10, 1987

[54] BOAT LIFT WITH SELF ALIGNING ATTACHMENT

[76] Inventor: James A. Pritchett, R.R. #2, Box 456, Grove, Okla. 74344

[21] Appl. No.: 733,087

[22] Filed: May 13, 1985

[51] Int. Cl.[4] ..... B63C 1/00

[52] U.S. Cl. ..... 114/44; 405/3

[58] Field of Search ..... 405/3; 114/44, 45, 48, 114/49, 263, 230; 308/4 R, 4 C

[56] References Cited

U.S. PATENT DOCUMENTS

| | | | |
|---|---|---|---|
| 2,965,064 | 12/1960 | Wallace | 114/230 |
| 3,603,276 | 9/1971 | De Lisle | 114/45 |
| 3,614,178 | 10/1971 | Stamm | 308/4 C |
| 3,683,838 | 8/1972 | Godbersen | 114/230 |
| 3,695,209 | 10/1972 | Grese | 114/230 |
| 3,857,248 | 12/1974 | Rutter | 405/3 |

*Primary Examiner*—Sherman D. Basinger
*Attorney, Agent, or Firm*—Edwin H. Crabtree

[57] ABSTRACT

A boat lift with self aligning attachment. The lift used for raising and lowering a boat in a boat slip. The slip disposed between spaced apart parallel dock sides. The lift adjustable for various widths of boat slips along with adjustment for the vertical height of the boat dock.

4 Claims, 5 Drawing Figures

BOAT LIFT WITH SELF ALIGNING ATTACHMENT

BACKGROUND OF THE INVENTION

A boat lift and more particularly, but not by way of limitation to a boat lift for attachment to spaced apart parallel sides of a boat dock and adjacent a boat slip.

Heretofore, there have been various types of boat lifts and boat hoists such as the devices found in the following U.S. Patent. They are: U.S. Pat. No. 4,391,550, U.S. Pat. No. 3,857,248, U.S. Pat. No. 3,169,644, U.S. Pat. No. 4,072,119 and U.S. Pat. No. 3,857,248. None of these prior art patents specifically disclose the unique features and advantages of the subject boat lift and dock aligning attachment.

SUMMARY OF THE INVENTION

The subject invention provides a boat lift with a dock attachment which is self aligning for mounting on various widths and lengths of boat slips having parallel dock sides.

The boat lift includes telescoping cross members to allow for adjustment should the dock sides fail to be completely parallel to each other.

The dock aligning attachment of the boat lift provides for vertical misalignment when raising and lowering the boat lift. Further, the attachment allows for vertical height adjustment when securing the boat lift to the sides of the dock.

The boat lift with dock aligning attachment prevents excessive wear due to misalignment when raising and lowering the boat lift by providing a vertical slide shaft for receiving a bearing assembly mounted on the ends of the boat lift frame.

The boat lift with dock aligning attachment used for raising and lowering a boat in a boat slip includes a pair of telescoping cross members perpendicular to the dock sides and having a boat support frame thereon for supporting the boat when the lift is raised. A pair of tanks are attached to the cross member and include the necessary air lines for pumping air into the tanks and returning water into the tank when lowering the tanks. The ends of the cross members include a bearing housing having a plurality of stainless steel ball bearings surrounding a vertical alignment shaft. The alignment shaft is attached to a height adjustment assembly which is secured to the dock side. When the lift is raised and lowered, the bearing assembly slides vertically along the length of the alingment shaft with the alignment shaft being flexible so that the ends of the cross members can slide up and down without restriction should there be misalignment due to dock movement or a change in the water level.

The advantages and objects of the invention will become evident from the following detailed description of the drawings when read in connection with the accompanying drawings which illustrate preferred embodiments of the invention.

DETAILED DESCRIPTION OF THE DRAWINGS

Figure 1:
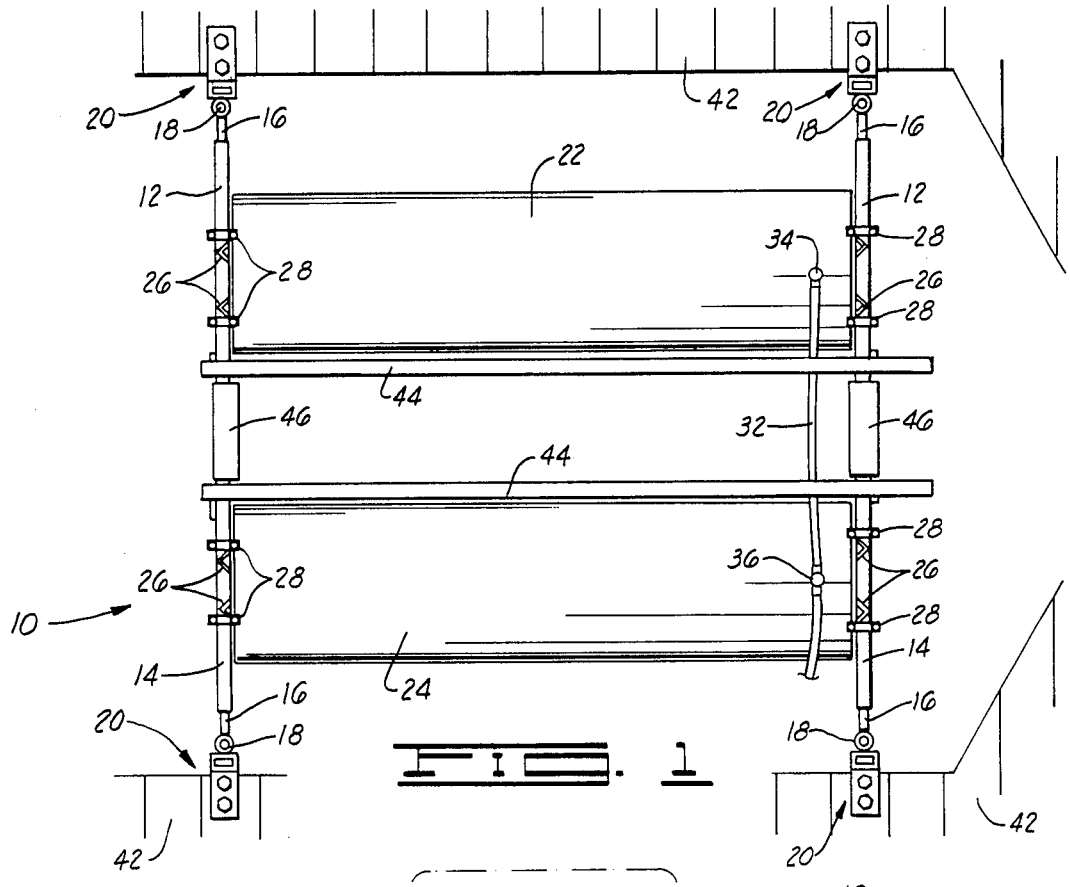
FIG. 1 illustrates a top view of the boat lift with dock aligning attachment secured to the sides of a dock.

In FIG. 1 the boat lift with dock aligning attachment is designated by general reference numeral 10. The lift 10 includes a pair of telescoping cross members 12 having an exterior member 14 and a telescoping interior member 16 for attachment to a vertical slide shaft 18 which is adjustably mounted on a height adjustment assembly designated by general reference numeral 20.

A pair of tanks 22 and 24 are attached to the cross members 12 by a pair of braces 26 which are welded to ends 27 of the tanks 22 and 24 with the top of the braces 26 secured to the cross members 12 by clamps 28. The tanks are further secured to each other by a horizontal brace 30 shown in FIG. 2.

Figure 2:
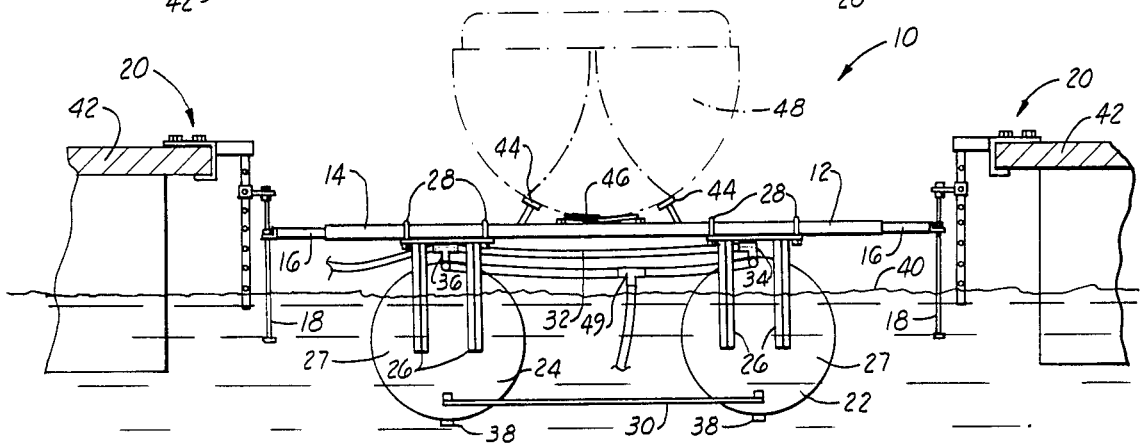
FIG. 2 illustrates a front view of the boat lift with a boat shown in dotted lines.

The tanks 22 and 24 further include an air pressure hose 32 connected to tank valves 34 and 36 for use with a standard air pressure pump not shown in the drawings for introducing air under pressure into the tanks 22 and 24 and discharging the water therein out tank valves 38 shown in the bottom of the tanks in FIG. 2. By introducing air, under pressure, into the tanks 22 and 24 and discharging the water, the boat lift 10 is raised above a water level 40 shown in FIG. 2.

In FIG. 1 it should be noted that the lift 10 is disposed in a boat slip between a pair of spaced apart parallel dock sides 42 with the height adjustment assembly 20 secured to the sides of the parallel sides 42. While the parallel dock sides 42 should be parallel to each other, quite often because of movement of the dock or other irregularities, the distance from the front of the dock sides and the rear of the dock sides is not equal in width and therefore the telescoping cross members 12 allow for proper adjustment in the attachment to the dock sides 42.

Referring now to both FIG. 1 and FIG. 2, a pair of parallel runners 44 with center supports 46 are attached to the cross members 12 for supporting a boat 48 shown in dotted lines. The lift 10 is lowered into the water by opening a valve 49, exhausting the air and allowing water to fill the tanks 22 and 24. The boat 48 is then positioned, while floating in the water, above and between the runners 44. When air pressure is pumped into the tanks discharging the water, the lift 10 raises vertically in the slip with the runners 44 engaging the bottom of the boat 48 and in turn raising the boat 48 above the water level 40 as shown in FIG. 2.

Figure 3:
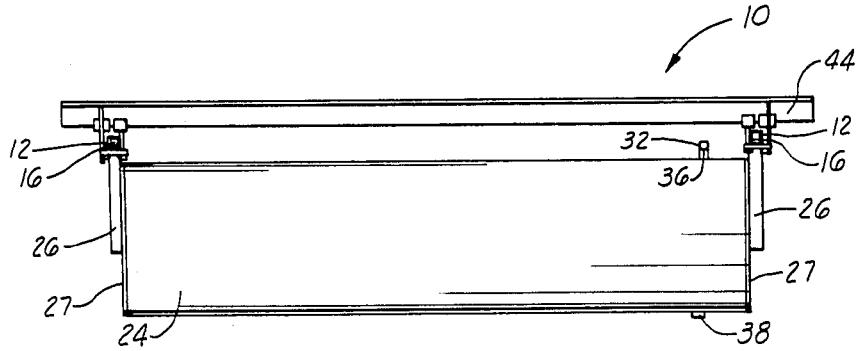
FIG. 3 illustrates a side view of the boat lift.

In FIG. 3 a side view of the boat lift 10 with dock aligning attachment can be seen. In this view, the vertical braces 26 can be seen attached to a reinforced end 27 of the cylindrical tanks 22 and 24. Also shown in this Fig. is one of the elongated runners 44 used for supporting the boat 48 thereon.

Figure 4:
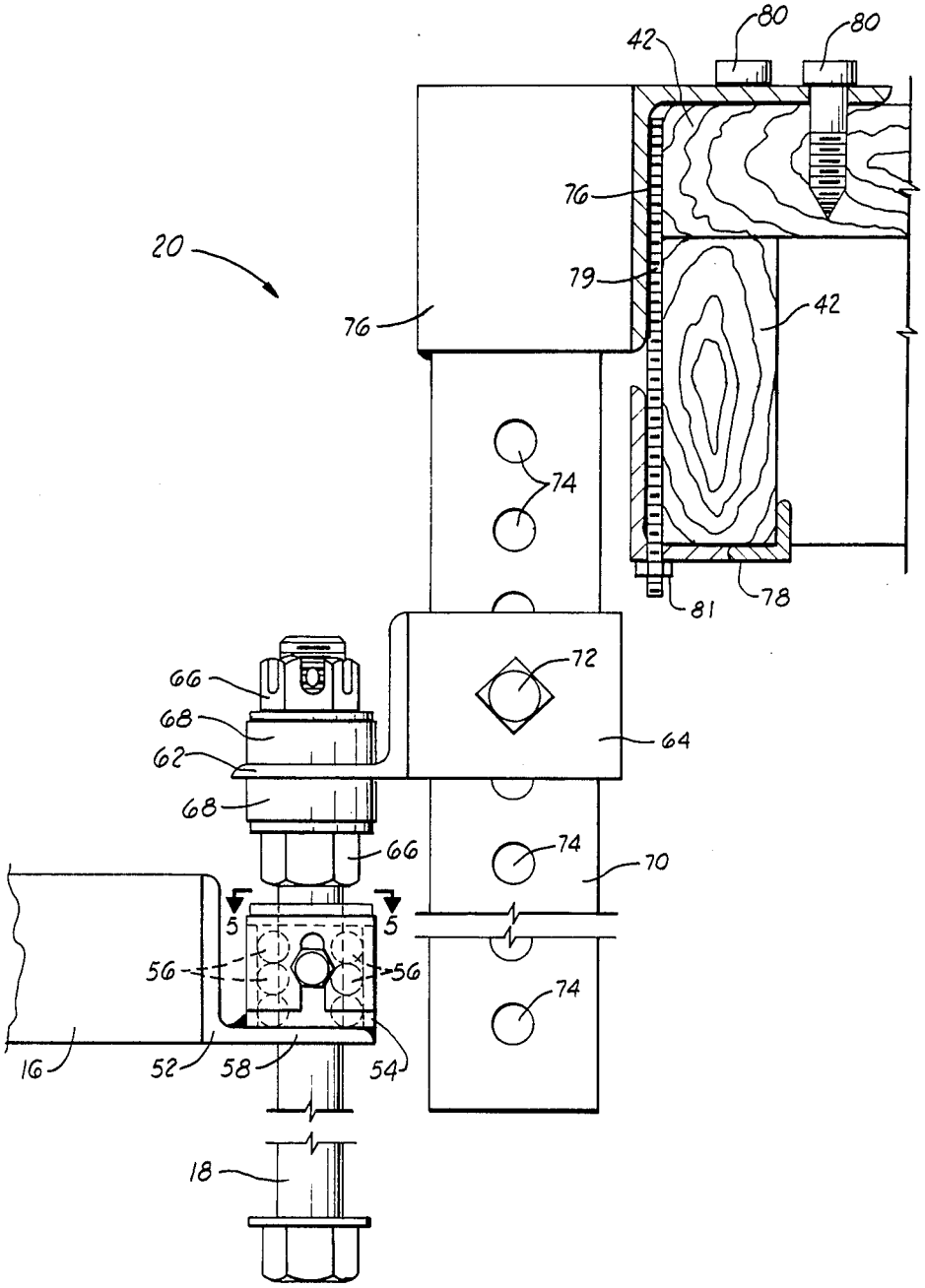
FIG. 4 illustrates an enlarged side view of the dock aligning attachment.

In FIG. 4 an enlarged view of the dock aligning attachment is shown for raising the lift 10 vertically above the water level when air pressure is pumped into the tanks 22 and 24. The ends of the cross members 12 include an "L" shaped bracket 52 attached to the interior telescoping member 16. Attached to the top of the "L" shaped bracket is a bearing housing 54 having a plurality of stainless steel ball bearings 56 shown in dotted lines. Received through an aperture 58 in the "L" shaped bracket 52 is the elongated vertical slide shaft 18 with the top of the shaft suspended from a bracket flange 62 which is part of a slidable height adjustment dock bracket 64. The top of the vertical alignment slide shaft 18 is secured to the flange by a pair of threaded nuts 66 with a pair of urethane dampening blocks 68 received on opposite sides of the flange 62 and allowing flexible movement of the vertical slide shaft 18 should there be misalignment when the lift 10 is raised and lowered in the slip. The shaft 18 may make any necessary alignment and move with the roller bearings 56 as the cross members 12 are raised and lowered along the length of the shaft 18. The bottom of the shaft includes a stop nut 69 to prevent the ends of the cross members 12 from coming free of the shafts 18 should the lift 10 be lowered too far.

The slidable height adjustment dock bracket 64 is adjustably attached to a vertical adjustment arm 70 by positioning the bracket 64 along its length and inserting a bolt 72 in a selected aperture 74 along the length of the arm 70. The top of the arm 70 is secured to a mounting bracket 75 which in turn is secured to the side of a split "U" shaped dock clamp assembly 78 which is received around the sides of the dock 42 and secured thereto by a pair of lag screws 80 and all thread screw 70 and nut 81. By the proper selection of the bracket 64 along the length of the vertical adjustment arm 70, the boat lift 10 can be properly adjusted as to the vertical height of the lift 10 above the water level 40.

Figure 5:
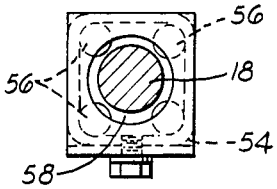
FIG. 5 illustrates a top sectional view taken along lines 5—5 shown in FIG. 4.

In FIG. 5 a top sectional view taken along lines 5—5 shown in FIG. 4 are illustrated and show the ball bearings 56 received in the housing 54 and disposed around the vertical slide shaft 18.

From reviewing the above figures, it can be seen that the boat lift with dock aligning attachment 10 is readily adaptable for various lengths and widths of boat slips and allowing for proper adjustment as to the width between a pair of parallel dock sides. Also the lift 10 can be adjusted for the correct vertical height above the water level 40 so that a boat can be properly raised above the water and lowered in the water when the boat is in use.

Changes may be made in the construction and arrangement of the parts or elements of the embodiments as described herein without departing from the spirit or scope of the invention defined in the following claims.

What is claimed is:

1. A boat lift with boat aligning attachment, the lift used for raising and lowering a boat in a boat slip, the slip disposed between spaced apart parallel dock sides, the boat lift comprising:

a pair of telescoping cross members perpendicular to the dock sides and having a boat support frame thereon for supporting the boat when the lift is raised;

at least one tank attached to the cross members;

means for pumping air into the tank and raising the lift and valve means for receiving water into to tank and lowering the lift;

four rigid vertical alignment shafts, the top of the shafts attached to and suspended from four height adjustment assemblies secured to the dock sides, the alignment shafts including dampening blocks attached to the top of the shafts for providing flexible movement of the shafts on the height adjustment assembly; and a bearing housing attached to the opposite ends of the cross member and including a plurality of ball bearings disposed in the housing and positioned around each alignment shaft for providing a bearing surface as the cross members are raised and lowered on the vertical alignment shafts.

2. A boat lift with dock aligning attachment, the lift used for raising and lowering a boat in a boat slip, the slip disposed between spaced apart parallel dock sides, the boat lift comprising:

a pair of telescoping cross members perpendicular to the dock sides and having a boat support frame thereon for supporting the boat when the lift is raised;

a pair of tanks attached to the cross members and perpendicular thereto;

means for pumping air into the tanks and raising the lift and valve means for receiving water into the tanks for lowering the lift;

four rigid vertical alignment shafts, the top of the shafts attached to and suspended from four height adjustment assemblies secured to the dock sides, the alignment shafts including dampening blocks attached to the top of the shafts for providing flexible movement of the shafts on the height adjustment assembly; and a bearing housing attached to the opposite ends of the cross members and including a plurality of ball bearings disposed in the housing and positioned around each alignment shaft for providing a bearing surface as the cross members are raised and lowered on the vertical shaft.

3. The boat lift as described in claim 1 wherein the height adjustment assembly includes a vertical adjustment arm attached to a dock clamp assembly, the dock clamp assembly secured to the sides of the dock sides and a slidable height adjustment bracket attached to the top of the alignment shafts and slidably received around the vertical adjustment arm and secured thereto.

4. The boat lift as described in claim 2 wherein the height adjustment assembly includes a split "U" shaped dock clamp assembly for securing the assembly to the dock sides, a vertical adjustment arm attached to the side of the "U" shaped dock clamp assembly and a slidable height adjustment bracket received around the vertical arm and adjustably mounted thereon, the bracket secured to the top of the vertical alignment shaft.

* * * * *